US010640903B2

(12) United States Patent
Bonnet et al.

(10) Patent No.: US 10,640,903 B2
(45) Date of Patent: May 5, 2020

(54) PROCESS FOR TREATING AT LEAST ONE GARMENT

(71) Applicant: The Procter & Gamble Company, Cincinnati, OH (US)

(72) Inventors: Guillaume Bonnet, Brussels (BE); Nans Elian Ravidat, Brussels (BE); Annalise Charlotte Richmond, Nijlen (BE); Paulus Antonius Augustinus Hoefte, Astene (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 16/005,960

(22) Filed: Jun. 12, 2018

(65) Prior Publication Data

US 2018/0355535 A1 Dec. 13, 2018

(30) Foreign Application Priority Data

| | | |
|---|---|---|
| Jun. 13, 2017 | (EP) | 17175837 |
| Jun. 13, 2017 | (EP) | 17175839 |
| Jun. 13, 2017 | (EP) | 17175844 |
| Apr. 11, 2018 | (EP) | 18166906 |

(51) Int. Cl.

| | |
|---|---|
| ***C11D 3/00*** | (2006.01) |
| ***D06B 1/02*** | (2006.01) |
| ***C11D 11/00*** | (2006.01) |
| *C11D 3/39* | (2006.01) |
| *D06B 3/30* | (2006.01) |

(52) U.S. Cl.

CPC ..... *D06B 1/02* (2013.01); *C11D 11/0005* (2013.01); *C11D 11/0017* (2013.01); *C11D 3/3947* (2013.01); *D06B 3/30* (2013.01)

(58) Field of Classification Search

CPC ..... C11D 3/3956; C11D 3/3947; D06B 1/02
See application file for complete search history.

(56) References Cited

U.S. PATENT DOCUMENTS

| | | | | |
|---|---|---|---|---|
| 4,954,286 | A | 9/1990 | Sepulveda | |
| 5,167,722 | A * | 12/1992 | Pastryk | D06F 35/06 134/33 |
| 2001/0054202 | A1 | 12/2001 | Severns et al. | |
| 2003/0224960 | A1 | 12/2003 | Scialla | |
| 2007/0021316 | A1 | 1/2007 | Dilley | |
| 2015/0135446 | A1 | 5/2015 | Kim | |
| 2018/0355294 | A1 | 12/2018 | Bonnet | |

FOREIGN PATENT DOCUMENTS

| | | | | |
|---|---|---|---|---|
| EP | 0839905 | A1 | 5/1998 | |
| EP | 1422334 | A2 * | 9/2000 | D06F 95/00 |
| EP | 1122302 | A1 | 8/2001 | |
| EP | 1422334 | A3 | 8/2004 | |
| GB | 2353287 | A | 2/2001 | |
| GB | 2395526 | B | 5/2007 | |
| JP | H03090676 | A | 4/1991 | |
| WO | WO9527026 | A1 | 10/1995 | |
| WO | WO9703178 | A1 | 1/1997 | |
| WO | WO9712024 | A1 | 4/1997 | |
| WO | WO0024856 | A1 | 5/2000 | |
| WO | WO0240624 | A1 | 5/2002 | |
| WO | WO2007010449 | A1 | 1/2007 | |
| WO | WO2007066302 | A3 | 10/2007 | |
| WO | WO2007120547 | A1 | 10/2007 | |
| WO | WO2009146275 | A1 | 12/2009 | |
| WO | WO2010094926 | A1 | 8/2010 | |
| WO | WO2015078764 | A1 | 6/2015 | |
| WO | WO2016202572 | A1 | 12/2016 | |

OTHER PUBLICATIONS

Extended European Search Report for Application No./Patent No. 17175837.8-1358, dated Nov. 21, 2017, 7 pages.
International Search Report for International Application Serial No. PCT/US2018/036994, dated Jul. 30, 2018, 13 pages.
European Search Report for Application No./Patent No. 17175839. 4-1358, dated Nov. 21, 2017, 7 pages (P&G Case CM4785F).
European Search Report for Application No./Patent No. 17175844. 4-1358, dated Nov. 21, 2017, 8 pages (P&G Case CM4786F).
European Search Report for Application No./Patent No. 18166906. 0-1106, dated May 11, 2018, 8 pages (P&G Case CM4786FM).

* cited by examiner

*Primary Examiner* — Eisa B Elhilo
(74) *Attorney, Agent, or Firm* — Gary J. Foose

(57) ABSTRACT

A process for treating at least one garment.

21 Claims, No Drawings

PROCESS FOR TREATING AT LEAST ONE GARMENT

FIELD OF THE INVENTION

A process for treating at least one garment.

BACKGROUND OF THE INVENTION

Laundry wash operations and the use of laundry treatment compositions are well known. However, for some laundry wash operations, current techniques are resource intensive, wasteful and environmentally unfriendly.

Laundry treatment compositions can provide cleaning and/or care benefits to garments. However, the wash operation with known laundry treatment often involves use of higher quantities of laundry treatment composition and washing in a 'full laundry wash cycle' in an automatic washing machine. This is based on an assumption by the formulators that maximum cleaning or treatment benefit needs to be provided to all fabrics under the conditions of the wash operation to ensure all fabrics are treated equally or maximally.

However, for some wash operations, such as delicate garments, lightly soiled garments, or garments simply in need of a 'refresh' (maybe after being hung in a wardrobe for a period of time), current wash practices can be wasteful in terms of resource and environmentally unfriendly. In other words, the volumes of laundry treatment composition traditionally used are not needed to achieve the desired benefit. In addition, with respect to the garments themselves, especially delicate garments, current wash process can be quite harsh on said garments. This may be from the harshness of the cleaning composition including amount of cleaning composition used, from mechanical friction and high temperatures in the washing machine, long wash times, or a mixture of these. Furthermore, often such delicate garments also require less intensive washing as they tend to have minimal soiling and/or only require a refresh.

Hence traditional wash operations can reduce the lifespan of a garment, especially delicate garments. This has a negative environmental impact as the consumer tends to discard the garment and replace it with a new one.

Therefore, there is a need for a wash operation in which less intense treatment of garments is required and which is more environmentally friendly.

It was surprisingly found that the present process provided such a wash operation.

SUMMARY OF THE INVENTION

A first aspect of the present invention is a process of treating at least one garment comprising the steps of;

a. Spraying the at least one garment with a laundry treatment composition;
b. Adding the at least one garment from step a to the drum of an automatic washing machine;
c. Washing the at least one garment from step a in the automatic washing machine wherein the drum comprises a wash liquor, wherein the wash liquor comprises water and the at least one garment from step a, wherein the wash liquor comprises between 50 ppm and 3000 ppm of the laundry treatment composition and wherein the only laundry treatment composition added to the drum of the automatic washing machine is that used in step a.

A second aspect of the present invention is the use of a process according to the present invention to treat garments, preferably wherein the garments comprise cotton, silk, wool, cashmere, viscose, polyamides, polyester, polyacrylics, polyurethanes or a mixture thereof, in order to minimise premature aging of the garments.

DETAILED DESCRIPTION OF THE INVENTION

The Process

The present invention discloses a process of treating at least one garment.

By 'garment' we herein mean an item of clothing. The garment may be made from natural fabrics, synthetic fabrics, or a mixture thereof, preferably made from natural fabrics.

The at least one garment preferably comprises cotton, silk, wool, cashmere, viscose, polyamides, polyester, polyacrylics, polyurethanes or a mixture thereof, preferably selected from cotton, wool, silk, cashmere or a mixture thereof, even more preferably selected from wool, silk, cashmere or a mixture thereof.

Preferably, the at least one garment is a delicate garment. Preferably such delicate garments comprise cotton, silk, wool, cashmere, viscose, polyamides, polyester, polyacrylics, polyurethanes or a mixture thereof, preferably selected from cotton, wool, silk, cashmere or a mixture thereof, even more preferably selected from wool, silk, cashmere or a mixture thereof.

Preferred polyamides include nylon.

The garment may be woven or non-woven or a mixture thereof. Preferably the at least one garment comprises a woven garment, more preferably a knitted garment.

Preferably at most 10 garments, more preferably at most 8 garments, even more preferably at most 5 garments, most preferably at most 3 garments or even only one garment are added to the drum of the automatic washing machine in the process of the present invention. Without wishing to be bound by theory, where fewer garments are present, friction between said garments during the wash process is reduced. Friction during the wash can prematurely age garments and reduce their lifespan.

The process of the present invention comprises a step;

a. spraying the at least one garment with a laundry treatment composition;

By 'spraying' we herein mean application of the laundry treatment composition to the at least one garment in the form of tiny droplets by using a spray dispenser. Suitable applicators for applying the laundry treatment composition as a spray are well known and those skilled in the art will be aware of them.

Preferably, the laundry treatment composition is contained within a bottle or canister. The bottle or canister comprises a spray applicator that when actuated by the user sprays the laundry treatment composition onto the at least one garment.

Those skilled in the art are aware of suitable spray applicators. Preferably, the spray dispenser comprises a housing to accommodate the composition of the invention and spraying means. Suitable spray dispensers include hand pump (sometimes referred to as "trigger") devices, pressurized can devices, electrostatic spray devices, etc. Preferably the spray dispenser is non-solvent propellant pressurized and the spray means are of the trigger dispensing type. Most preferably the spray dispenser is a long duration trigger dispensing type sprayer such as the Flairosol propellant-free sprayer with continuous fine mist spray, as commercially available from the AFA dispensing company.

In step a each garment may be sprayed with the laundry treatment composition between 1 and 20 times, preferably between 1 and 10 times, more preferably between 1 and 4 times. Without wishing to be bound by theory, the user has the flexibility to spray the entire garment or a specific area, such as a stain. Alternatively the user could spray multiple areas of the garment, but not the entire garment.

In step a each garment may be sprayed such that between 5% and 100% of the outer surface of the garment is in contact with the laundry treatment composition.

When spraying specific areas then a lower percentage of the surface of the garment may be in contact with the laundry treatment composition. Between 5% and 50%, preferably between 5% and 30%, even more preferably between 5% and 10% of the surface of the garment may be in contact with the laundry treatment composition.

When desiring to spray the garment more widely, then preferably between 50% and 100%, more preferably between 65% and 100%, even more preferably between 75% and 100% of the surface of the garment may be in contact with the laundry treatment composition.

The 'surface of the garment' can include the outer surface, the inner surface or a mixture thereof. The inner surface should be understood to mean that surface which faces the body of the user when wearing the garment and the outer surface should be understood to mean the surface facing out from the body of the user when wearing the garment.

To avoid any doubt, any laundry treatment composition present in the wash liquor in step c is that composition which is present on the at least one garment from step a. In other words, when the garment from step a is added to water to create the wash liquor, some of the laundry treatment composition present on the at least one garment from step a moves from the garment into the water. The components of the laundry treatment composition in the water may then redeposit onto and/or interact with the garment and/or stain/soil present on the garment during the wash process.

After step a no further laundry treatment composition is added to the at least one garment prior to it being added to the drum of the automatic washing machine, nor further laundry treatment composition is added after the at least one garment is added to the drum prior to wash cycle nor during the wash cycle. Optionally a further fabric softening or conditioning composition can be added during a rinse cycle. Preferably no further fabric softening or conditioning composition is added during the rinse cycle, i.e. the laundry treatment composition added in step a is the sole treatment composition used during the entire wash process.

The at least one garment in step a may comprise laundry treatment composition or ingredients of laundry treatment compositions on it prior to being sprayed with the laundry treatment composition in step a. For example the garment may have been washed previously in a wash operation, then dried and then worn by the consumer. Some laundry treatment composition may remain on the garment from said previous wash. The at least one garment to be treated may have previously been treated at least once, preferably at least twice, even more preferably at least three times in a fabric treatment process, preferably a fabric treatment process according to the present invention.

Preferably at most 10 garments, preferably at most 8 garments, more preferably at most 5 garments, most preferably at most 3 garments or even only one garment are sprayed with the laundry treatment composition in step a.

The laundry treatment composition is described in more detail below.

The process of the present invention comprises a step;

b. Adding the at least one garment from step a to the drum of an automatic washing machine.

Preferably at most 10 garments, preferably at most 8 garments, more preferably at most 5 garments, most preferably at most 3 garments or even only one garment are added to the drum of the automatic washing machine.

Those skilled in the art will be familiar with automatic washing machines, and where the drum is located in said machines. Without wishing to be bound by theory the drum is the area within an automatic washing machine in which the garments are washed during the wash operation.

The automatic washing machine may be a domestic washing machine or an industrial/commercial washing machine.

The drum may be located such that the garments are loaded at the front (so called front loader) or from the top (so called top loader).

The process of the present invention comprises a step;

c. Washing the at least one garment from step a in the automatic washing machine wherein the drum comprises a wash liquor, wherein the wash liquor comprises water and the at least one garment from step a, wherein the wash liquor comprises between 50 ppm and 3000 ppm of the laundry treatment composition and wherein the only laundry treatment composition added to the drum of the automatic washing machine is that used in step a.

Those skilled in the art will be aware of the standard operation of an automatic washing machine including formation of the wash liquor. Without wishing to be bound by theory, a wash liquor is formed in situ in the drum of the automatic washing machine. The automatic washing machine puts water into the drum wherein the at least garment is present. The combination of the water and at least one garment, together with the laundry treatment composition sprayed onto the at least one garment creates the wash liquor. The automatic washing machines then performs a series of steps to wash the at least one garment in a wash operation, or also known as a wash cycle.

Sufficient laundry treatment composition is sprayed onto the at least one garment such that in step c, the wash liquor comprises between 50 ppm and 3000 ppm, preferably between 75 ppm and 2500 ppm, more preferably between 100 ppm and 2000 ppm, even more preferably between 125 ppm and 1750 ppm, yet more preferably between 150 ppm and 1500 ppm, most preferably between 175 ppm and 1250 ppm of the laundry treatment composition.

Preferably, the wash liquor has a temperature of 40° C. or less, preferably between 5° C. and 40° C., preferably between 6° C. and 35° C., more preferably between 7° C. and 30° C.

Preferably, step c takes between 1 minute and 90 minutes, preferably between 5 minutes and 60 minutes, more preferably between 5 minutes and 40 minutes, even more preferably between 5 minutes and 30 minutes, most preferably between 6 minutes and 20 minutes to complete.

Preferably, between 7 L and 70 L, more preferably between 7 L and 50 L, even more preferably between 7 L and 30 L, most preferably between 7 L and 20 L of water are added to the drum to create the wash liquor.

The drum of the automatic washing machine preferably rotates at a speed of between 0 rpm and 1700 rpm, more preferably between 100 rpm and 1500 rpm, even more preferably 100 rpm and 1300 rpm, most preferably between 100 rpm and 1000 rpm during the wash process.

The at least one garment may be washed in a normal wash cycle, a delicate wash cycle, a short wash cycle, a rinse cycle only, a wool wash cycle or a mixture thereof.

Preferably, the drum comprises less than 7 kg, preferably less than 5 kg, more preferably less than 3 kg, even more preferably less than 2 kg, or most preferably less than 1 kg of garments to be washed.

Without wishing to be bound by theory, the spray operation allows the consumer to tailor the amount of treatment composition added to the garments and where to add it. This reduces waste/loss of excess laundry treatment composition lost through the wash.

Furthermore, the specific choice of wash conditions allows for reduced energy needed in the wash operation especially since a full intense wash cycle is not needed. Avoidance of overuse of cleaning chemistry means that the volume of rinse water and amount of time needed to run the wash cycle are both reduced resulting in less energy and resource needed during the wash operation.

In addition the wash operation is less intensive to delicate garments as there is reduced mechanical friction and less intensive cleaning compositions.

Laundry Treatment Composition

The process comprises the step of spraying at least one garment with a laundry treatment composition. The laundry treatment composition maybe a laundry detergent composition, a laundry softening composition, a laundry care composition, a laundry scent refresher composition or a mixture thereof. Preferably the laundry treatment composition has both cleaning, refreshing and care properties, the latter including fabric softness and fabric shape and texture retention properties.

Surfactant

Preferably, the laundry treatment composition comprises a surfactant, preferably wherein the surfactant is a non-soap surfactant preferably selected from non-soap anionic surfactant, non-ionic surfactant or a mixture thereof. Preferably, the laundry treatment composition comprises between 1% and 15%, preferably between 4% and 12%, more preferably between 5% and 10% by weight of the laundry treatment composition of a non-soap surfactant.

The non-soap surfactant comprises an anionic surfactant, a non-ionic surfactant, or a mixture thereof.

Preferably, the liquid laundry treatment composition comprises less than 15%, preferably between 0.5% and 10%, more preferably between 1% and 9%, even more preferably between 2% and 8%, most preferably between 3% and 7% by weight of the liquid laundry treatment composition of the non-soap anionic surfactant.

The non-soap anionic surfactant may comprise a sulphate or a sulphonate anionic surfactant or a mixture thereof, preferably linear alkylbenzene sulphonate, alkyl sulphate, alkoxylated alkyl sulphate or a mixture thereof, more preferably a mixture of alkoxylated alkyl sulphate and linear alkylbenzene sulphonate.

Preferably, the alkoxylated alkyl sulphate is an ethoxylated alkyl sulphate with an average degree of ethoxylation of between 0.5 and 7, preferably between 1 and 5, more preferably between 2 and 4, most preferably about 3. The ethoxylated alkyl sulphate may have an average alkyl chain length of between 8 and 18, preferably between 10 and 16, more preferably between 12 and 14.

Preferably, the weight ratio of alkoxylated alkyl sulphate to linear alkylbenzene sulphonate is between 100:0 and 50:50, preferably between 90:10 and 60:40, more preferably between 85:15 and 70:30.

The liquid laundry treatment composition may comprise less than 15%, preferably between 0.1% and 10%, preferably between 0.2% and 5%, more preferably between 0.3% and 2%, most preferably between 0.5% and 1% by weight of the liquid laundry treatment composition of a nonionic surfactant or a mixture thereof.

Preferably, the non-ionic surfactant is selected from alcohol alkoxylate nonionic surfactants preferable selected from a natural or olefin derived fatty alcohol alkoxylate, an oxo-synthesised fatty alcohol alkoxylate, Guerbet fatty alcohol alkoxylates, alkyl phenol alcohol alkoxylates or a mixture thereof.

Preferably the non-ionic surfactant is an alcohol alkoxylate non-ionic surfactant, most preferably an alcohol ethoxylate non-ionic surfactant, even more preferably a mixture of alcohol ethoxylate nonionic surfactants.

The fatty alcohol alkoxylate has an average degree of alkoxylation of between 0.5 and 10, preferably between 1 and 9, more preferably between 3 and 8, more preferably a degree of ethoxylation of between 0.5 and 10, preferably between 1 and 9, more preferably between 3 and 8, even more preferably between 5 and 8 or most preferably from 7 to 8.

The fatty alcohol alkoxylate may have an average alkyl chain length of between 8 and 18, preferably between 10 and 16, more preferably between 12 and 15.

More preferably the non-ionic surfactant comprises a mixture of alcohol ethoxylate surfactants, especially a mixture of a mid cut and a high cut alcohol ethoxylate with an average degree of ethoxylation of the mid cut and high cut alcohol ethoxylates of from 7 to 8. The mid cut alcohol ethoxylate is defined as having an average carbon chain length of from 12 to 14, the high cut alcohol ethoxylate is defined as having an average carbon chain length of from 14 to 15. The mid cut and high cut alcohol ethoxylate preferably are in a weight ratio of from 80:20 to 20:80, preferably 60:40 to 40:60.

The weight ratio of non-soap anionic surfactant to non-ionic surfactant ratio may be between 55:45 and 100:0, preferably between 60:40 and 95:5, more preferably between 70:30 and 90:10.

The non-soap surfactant may comprise between 80% and 100% preferably between 90% and 100% or even between 95% and 100% preferably about 100% by weight of the non-soap surfactant of the anionic surfactant, non-ionic surfactant or a mixture thereof, preferably a mixture thereof.

Without wishing to be bound by theory such a surfactant system is found to provide strong cleaning while still controlling overall foam profile, resulting in lower volumes of water needed to rinse the fabrics. These lower volumes result in a more environmentally friendly process.

The laundry treatment composition may comprise further surfactant selected from amphoteric surfactants including amine oxides, zwitterionic surfactants including betaines, sulfobetaines and sulfosuccinates, and cationic surfactants. Further addition of these surfactants is not preferred however in order to control the total amount of foam being formed during the wash cycle, resulting in more effective foam rinsing accordingly.

The laundry treatment composition may comprise less than 10%, preferably less than 8%, more preferably less than 5%, even more preferably less than 3%, or even more preferably less than 1% by weight of the laundry treatment composition of fatty acid, neutralised fatty acid soap or a mixture thereof. Most preferably the composition is free of fatty acid, neutralized fatty acid soap or a mixture thereof. Without wishing to be bound by theory fatty acid soaps are believed to complex with water hardness, potentially leaving encrusted salts on the fabrics accordingly.

When present, the neutralised fatty acid soap may be alkali metal neutralised, amine neutralised or a mixture thereof. The alkali metal may be selected from sodium, potassium, magnesium or a mixture thereof, preferably sodium. The amine is preferably an alkanolamine, preferably selected from monethanolamine, diethanolamine, triethanolamine or a mixture thereof, more preferably monoethanolamine. The fatty acid, neutralised fatty acid soap or mixture thereof may be selected from palm kernel fatty acid, coconut fatty acid, rapeseed fatty acid, neutralized palm kernel fatty acid, neutralized coconut fatty acid, neutralized rapeseed fatty acid, or mixture thereof, preferably neutralized palm kernel fatty acid.

Cationic Polymer

Preferably, the liquid laundry treatment composition comprises between 0.1% and 5%, preferably from 0.2% to 1%, more preferably from 0.3% to 0.7% by weight of the liquid laundry treatment composition of a polymer selected from a cationic polymer, a polysaccharide polymer, or a mixture thereof, preferably a cationic polymer. The cationic polysaccharide technology will further provide fabric conditioning benefits including softness and multi-cycle shape retention benefits, as well as will be contributing to control the dispersion of fine particles upon spraying.

Preferably, the cationic polymer, is a cationically modified polysaccharide, preferably selected from cationic guar gums, cationic cellulosic polymers, and mixtures thereof, most preferably cationic cellulosic polymers even more preferably cationically modified hydroxyethyl cellulose, most preferably, hydroxyethyl cellulose derivatised with trimethyl ammonium substituted epoxide.

By "hydrophobically modified" we herein mean that one or more hydrophobic groups are bound to the polymer. By "cationically modified" we herein mean that one or more cationically charged groups are bound to the polymer.

The cationically modified hydroxyethyl cellulose preferably is hydroxyethyl cellulose derivatised with trimethyl ammonium substituted epoxide.

The cationic polysaccharide polymer can be synthesized in, and are commercially available in, a number of different molecular weights. In order to achieve optimal spray control, as well as softening and care performance from the product, it is desirable that the cationic polymer used in this invention be of an appropriate molecular weight. Without wishing to be bound by theory, it is believed that polymers that are too high in mass can entrap soils and prevent them from being removed, as well as will be providing physical stability challenges especially in low viscous liquors required for spraying. The use of cationic polymers with an average molecular weight of less than about 850,000 daltons, and especially those with an average molecular weight of less than 500,000 daltons can help to minimise this effect without significantly reducing the softening performance of properly formulated products while providing the desired optimum spray pattern. On the other hand, polymers with a molecular weight of about 10,000 daltons or less are believed to be too small to give an effective softening benefit, nor being able to prevent dispersion of fine droplets. Therefore the cationic polymer according to the invention preferably has a molecular weight of from about 10,000 daltons to about 850,000 daltons, preferably from about 50,000 daltons to about 750,000 daltons, more preferably from about 100,000 daltons to about 600,000 daltons, most preferably from about 200,000 daltons to about 500,000 daltons.

The cationic polymers according to the invention may also have a cationic charge density ranging from about 0.1 meq/g to about 5 meq/g, preferably from about 0.15 meq/g to about 4 meq/g, more preferably from about 0.2 meq/g to about 2.5 meq/g, even more preferably from about 0.25 meq/g to about 1.5 meq/g, most preferably from about 0.25 meq/g to about 0.7 meq/g, at the pH of intended use of the laundry composition. As used herein the "charge density" of the cationic polymers is defined as the number of cationic sites per polymer gram atomic weight (molecular weight), and can be expressed in terms of meq/gram of cationic charge. In general, adjustments of the proportions of amine or quaternary ammonium moieties in the polymer in function of the pH of the liquid laundry formulation in the case of amines, will affect the charge density. Without intending to be bound by theory, cationic polymers with a too high charge density are thought to be too sensitive to precipitate out with anionic compounds in the formulation and will as such not be present anymore to help prevent fine droplet dispersion, while cationic polymers with a too low charge density are thought to have a too low affinity to fabrics, compromising softness accordingly. Any anionic counterions can be used in association with cationic polymers. Non-limiting examples of such counterions include halides (e.g. chlorine, fluorine, bromine, iodine), sulphate and methylsulfate, preferably halides, more preferably chlorine.

The cationic polymer according to the invention might be "hydrophobically modified". We herein mean that one or more hydrophobic groups are bound to the polymer. Without intending to be bound by theory we believe that hydrophobic modification can increase the affinity of the polymer towards the fabric, as well as enable better binding of individual spray particles by associating to the dissolved surfactant molecules, preventing file particle dispersion accordingly. Without intending to be limiting, the one or more hydrophobic groups can be independently selected from $C_1$-$C_{32}$ preferably $C_5$-$C_{32}$ alkyl; $C_1$-$C_{32}$ preferably $C_5$-$C_{32}$ substituted alkyl, $C_5$-$C_{32}$ alkylaryl, or $C_5$-$C_{32}$ substituted alkylaryl, (poly)alkoxy $C_1$-$C_{32}$ preferably $C_5$-$C_{32}$ alkyl or (poly) alkoxy substituted $C_1$-$C_{32}$ preferably $C_5$-$C_{32}$ alkyl or mixtures thereof. Hydrophobic substitution on the polymer, preferably on the anhydroglucose rings of the cationic polymer may range from 0.01% to 5% per glucose unit, more preferably from 0.05% to 2% per glucose unit, of the polymeric material.

The cationic polysaccharide polymers according to the invention include those which are commercially available and further include materials which can be prepared by conventional chemical modification of commercially available materials. Commercially available cationic cellulose polymers according to the invention include those with the INCI name Polyquaternium 10, such as those sold under the trade names: Ucare Polymer JR 30M, JR 400, JR 125, LR 400 and LK 400 polymers; Polyquaternium 67 such as those sold under the trade name Softcat SK™, all of which are marketed by Amerchol Corporation, Edgewater N.J.; and Polyquaternium 4 such as those sold under the trade name: Celquat H200 and Celquat L-200, available from National Starch and Chemical Company, Bridgewater, N.J. Other suitable polysaccharides include hydroxyethyl cellulose or hydroxypropylcellulose quaternized with glycidyl $C_{12}$-$C_{22}$ alkyl dimethyl ammonium chloride. Examples of such polysaccharides include the polymers with the INCI names Polyquaternium 24 such as those sold under the trade name Quaternium LM 200 by Amerchol Corporation, Edgewater N.J.

Alternatively synthetic derived cationic polymers can also be used within the scope of the application.

The cationic polymer and non-soap surfactant system are preferably formulated in a non-soap surfactant to cationic polymer weight ratio between 1:1 and 25:1, preferably between 5:1 and 22:1, even more preferably between 10:1 and 20:1, most preferably between 12:1 and 17:1. Without wishing to be bound by theory the laundry treatment composition is thought to provide an effective balance between cleaning and care properties.

Chelant

The laundry treatment composition may comprise less than 3%, preferably less than 2%, more preferably less than 1%, even more preferably between 0.01% and 0.5%, most preferably between 0.05% and 0.3% by weight of the laundry treatment composition of a chelant, preferably wherein the chelant is selected from amino carboxylates, amino phosphonates, polyfunctionally-substituted aromatic chelating agents and mixtures thereof, preferably selected from the group consisting of glutamic-N,N-diacetic acid (GLDA), methyl-glycine-diacetic acid (MGDA), Diethylenetriamine penta methylphosphonic acid (DTPMP), 1-hydroxyethane 1,1-diphosphonic acid (HEDP), ethylenediaminetetra-acetates (EDTA), N-hydroxyethylethylenediaminetriacetates, nitrilo-triacetates (NTA), ethylenediamine tetrapro-prionates, triethylenetetraaminehexacetates, diethylenetriaminepentaacetates, aspartic acid-N-monoacetic acid (ASMA), aspartic acid-N, N-diacetic acid (ASDA), aspartic acid-N-monopropionic acid (ASMP), iminodisuccinic acid (IDS), Imino diacetic acid (IDA), N-(2-sulfomethyl) aspartic acid (SMAS), N-(2-sulfoethyl) aspartic acid (SEAS), N-(2-sulfomethyl) glutamic acid (SMGL), N-(2-sulfoethyl) glutamic acid (SEGL), N-methyliminodiacetic acid (MIDA), alanine-N,N-diacetic acid (ALDA), serine-N,N-diacetic acid (SEDA), isoserine-N,N-diacetic acid (ISDA), phenylalanine-N,N-diacetic acid (PHDA), anthranilic acid-N,N-diacetic acid (ANDA), sulfanilic acid-N, N-diacetic acid (SLDA), taurine-N, N-diacetic acid (TUDA) and sulfomethyl-N,N-diacetic acid (SMDA), ethylenediamine disuccinate ("EDDS"), Hydroxyethyleneiminodiacetic acid, Hydroxyiminodisuccinic acid, Hydroxyethylene diaminetriacetic acid, or a mixture thereof, more preferably the chelant is selected from the group consisting of glutamic-N,N-diacetic acid (GLDA), methyl-glycine-diacetic acid (MGDA) and derivatives thereof, and/or Diethylenetriamine penta methylphosphonic acid (DTPMP), 1-hydroxyethane 1,1-diphosphonic acid (HEDP), and derivatives thereof, and mixtures thereof, most preferably Diethylenetriamine penta methylphosphonic acid (DTPMP). Without wishing to be bound by theory, the lower chelant levels are preferred to provide a less harsh laundry treatment composition while still facilitating stain removal especially bleachable stain removal.

The laundry treatment composition preferably comprise a polycarboxylate, preferably selected from the group of consisting of malonic acid, (ethylenedioxy) diacetic acid, maleic acid, diglycolic acid, tartaric acid, tartronic acid, fumaric acid, citric acid, more preferably citric acid, wherein the citric acid is preferably present at a level of 0.1% to 5%, preferably from 0.5% to 3% most preferably from 1% to 2% by weight of the liquid treatment composition. Without wishing to be bound by theory, the lower polycarboxylate levels are preferred to provide a less harsh laundry treatment composition while still facilitating stain removal especially bleachable stain removal. In addition, they may help to protect the surfactant system against water hardness by complexing calcium and magnesium ions present in the wash liquor.

Polymer

The laundry treatment composition may comprise less than 3%, preferably less than 2%, more preferably less than 1.5%, even more preferably between 0.01% and 1%, most preferably between 0.05% and 0.5% by weight of the laundry treatment composition of a soil release polymer, preferably selected from the group of polyester terephthalates, polyethylene glycol containing soil release polymers and a mixture thereof. An example of a preferred polyethyleneglycol containing soil release polymer comprises a polyethylene glycol graft polymer comprising a polyethylene glycol backbone (Pluriol E6000) and hydrophobic vinyl acetate side chains, comprising 40% by weight of the polymer system of a polyethylene glycol backbone polymer and 60% by weight of the polymer system of the grafted vinyl acetate side chains. Polyester terephtalate soil release polymers are commercially available from Clariant under the Texcare SRN and SRA tradenames. One particularly preferred polyester terephtalate soil release polymer is Texcare SRA300.

Preferably, the laundry treatment composition comprises a polyethyleneimine, preferably an alkoxylated polyethyleneimine, more preferably an ethoxylated polyethyleneimine and wherein preferably the laundry treatment composition comprises less than 3%, preferably less than 2%, more preferably less than 1.5%, even more preferably between 0.01% and 1%, most preferably between 0.05% and 0.5% by weight of the laundry treatment composition of the polyethyleneimine, preferably ethoxylated polyethyleneimine.

The ethoxylated polyethyleneimine may have a polyethyleneimine backbone of weight average molecular weight of between 100 g/mol and 2000 g/mol, preferably between 200 g/mol and 1500 g/mol, more preferably between 300 g/mol and 1000 g/mol, even more preferably between 400 g/mol and 800 g/mol, most preferably between 500 g/mol and 700 g/mol, preferably about 600.

The ethoxylation chains within the ethoxylated polyethyleneimine may be from 200 g/mol to 2000 g/mol weight average molecular weight, preferably from 400 g/mol to 1500 g/mol weight average molecular weight, more preferably from 600 g/mol to 1000 g/mol weight average molecular weight, most preferably about 880 g/mol weight average molecular weight per ethoxylated chain.

The ethoxylation chains within the ethoxylated polyethyleneimine polymer of the present composition have on average 5 to 40, preferably 10 to 30, more preferably 15 to 25, even more preferably 18 to 22, most preferably about 20 ethoxy units per ethoxylation chain.

The ethoxylated polyethyleneimine may have a total weight average molecular weight of from 5000 g/mol to 20000 g/mol, preferably from 7500 g/mol to 17500 g/mol, more preferably from 10000 g/mol to 15000 g/mol, even more preferably from 12000 g/mol to 13000 g/mol, most preferably about 12700 g/mol.

A preferred polyethyleneimine has the general structure of formula (I):

formula (I)

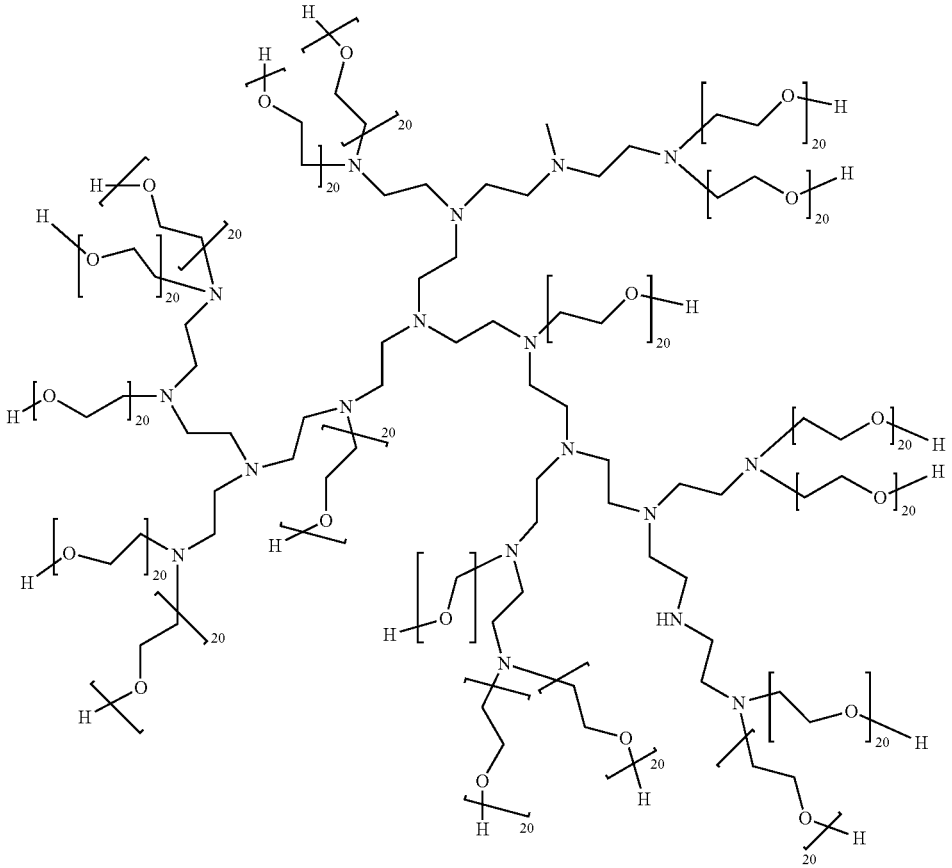

wherein the polyethyleneimine backbone has a weight average molecular weight of about 600 g/mol, n of formula (I) has an average of about 20. Each polyethoxy chain is hydrogen capped. The degree of permanent quaternization of formula (I) is about 0% of the polyethyleneimine backbone nitrogen atoms. The molecular weight of this polyethyleneimine preferably is between 10000 and 15000 g/mol, more preferably about 12700 g/mol.

The described ethoxylated polyethyleneimines can be made using techniques previously described in the art, and as such those skilled in the art would understand how to produce such compounds. These polyethyleneimines can be prepared, for example, by polymerizing ethyleneimine in the presence of a catalyst such as carbon dioxide, sodium bisulfite, sulfuric acid, hydrogen peroxide, hydrochloric acid, acetic acid, and the like, followed by an ethoxylations step.

Without wishing to be bound by theory, the presence of a polyethyleneimine is preferred to provide improved cleaning benefit whilst still providing a less harsh treatment composition.

Preferably, the weight ratio of polyethyleneimine to soil release polymer, more preferably the ratio of ethoxylated polyethyleneimine to soil release polymer is higher than 1:1, preferably between 1.1:1 and 5:1, more preferably between 1.2:1 and 3:1, most preferably between 1.3:1 and 2:1.

Zwitterionic Polyamine

Preferably, the laundry treatment composition comprises less than 3%, preferably less than 2%, more preferably less than 1.5%, even more preferably between 0.01% and 1%, most preferably between 0.05% and 0.5% of a zwitterionic polyamine. Particularly preferred zwitterionic polyamines are zwitterionic hexamethylene diamines according to the following formula:

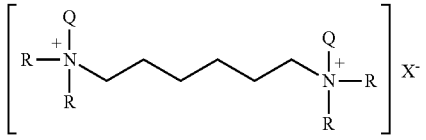

R is an anionic or partially anionic unit-capped polyalkyleneoxy unit having the formula: —$(R2O)_xR3$ wherein R2 is C2-C4 linear or branched alkylene, and mixtures thereof, preferably C2 or branched C3 and mixtures thereof, even more preferably C2 (ethylene); R3 is hydrogen, an anionic unit, and mixtures thereof, in which not all R3 groups are hydrogen; x is from about 5 to about 50, preferably from about 10 to about 40, even more preferably from about 15 to about 30, most preferably from about 20 to about 25. A preferred value for x is 24, especially when R comprises entirely ethyleneoxy units. Depending upon the method by which the formulator chooses to form the alkyleneoxy units, the wider or narrower the range of alkyleneoxy units present. The formulator will recognize that when ethoxylating a zwitterionic polyamine, only an average number or statistical distribution of alkyleneoxy units will be known. x values highlighted represent average values per polyalkoxy chain.

Preferably the range of alkyleneoxy units within the zwitterionic polyamine is plus or minus two units, more preferably plus or minus one unit. Most preferably each R group comprises about the same average number of alkyleneoxy units. Non-limiting examples of R3 anionic units include —(CH2)pCO2M; —(CH2)qSO3M; —(CH2)qOSO3M; —(CH2)qCH(SO2M)-CH2SO3M; —(CH2)qCH(OSO2M)CH2OSO3M; —(CH2)qCH(SO3M)CH2SO3M; —(CH2)pPO3M; —PO3M; —SO3M and mixtures thereof; wherein M is hydrogen or a water soluble cation in sufficient amount to satisfy charge balance. Preferred anionic units are —(CH2)pCO2M; —SO3M, more preferably —SO3M (sulfonate group). The indices p and q are integers from 0 to 6, preferably 0 to 2, most preferably 0. For the purposes of the present invention, all M units, can either be a hydrogen atom or a cation depending upon the form isolated by the artisan or the relative pH of the system wherein the compound is used. Non-limiting examples of preferred cations include sodium, potassium, ammonium, and mixtures thereof.

Q is a quaternizing unit selected from the group consisting of C1-C30 linear or branched alkyl, C6-C30 cycloalkyl, C7-C30 substituted or unsubstituted alkylenearyl, and mixtures thereof, preferably C1-C30 linear or branched alkyl, even more preferably C1-C10 or even C1-C5 linear or branched alkyl, most preferably methyl; the degree of quaternization preferably is more than 50%, more preferably more than 70%, even more preferably more than 90%, most preferably about 100%.

X is an anion present in sufficient amount to provide electronic neutrality, preferably a water soluble anion selected from the group consisting of chlorine, bromine, iodine, methylsulfate, and mixtures thereof, more preferably chloride. To a great degree, the counter ion X will be derived from the unit which is used to perform the quaternization. For example, if methyl chloride is used as the quaternizing agent, chlorine (chloride ion) will be the counter ion X. Bromine (bromide ion) will be the dominant counter ion in the case where benzyl bromide is the quaternizing reagent.

Preferably from about 10% to about 100%, more preferably from about 20% to about 70%, even more preferably from 30% to about 50%, most preferably from about 35% to about 45% of the R3 groups are an anionic unit, preferably a sulfonate unit, the remaining R3 units being hydrogen.

Most preferred compound is the zwitterionic hexamethylene diamine represented by the following formula:

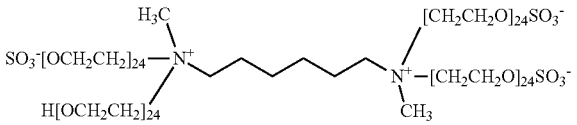

in which approximately 40% of the polyethoxy groups are sulfonated, the remaining polyethoxy groups being hydrogen capped. The degree of quaternization preferably is more than 90%, most preferably about 100%. Preferably the water soluble counter-anion is selected from the group consisting of chlorine, bromine, iodine, methylsulfate, and mixtures thereof, more preferably chloride.

Without wishing to be bound by theory, the presence of the zwitterionic polyamine is preferred to provide improved cleaning benefit whilst still providing a less harsh treatment composition.

Perfume

The liquid laundry detergent composition will preferably comprise perfume materials. Those skilled in the art will be aware of suitable perfume materials.

Adjunct Materials

The laundry treatment composition preferably comprises water as a carrier in which all other materials are dissolved. Optionally the laundry treatment composition further comprises adjunct materials selected from the group of dyes, opacifiers, pearlescent agents, preservatives, antioxidants, pH trimming agents, organic solvents, rheology control agents or a mixture thereof.

When present, organic solvents preferably are selected from alcohol or glycol based solvents, such as ethanol, propanol, propanediol, dipropyleneglycol, ethyleneglycol, polyethyleneglycol and polypropyleneglycol and formulated between 0.01% and 5% preferably between 0.1% and 3% by weight of the laundry treatment composition. Careful selection of organic solvent type and level is required in order not to damage sensitive garments.

The laundry treatment composition may comprise but preferably is free of enzymes and bleaching compounds.

The liquid laundry treatment composition preferably has a pH between 6 and 10, more preferably between 7 and 9, most preferably between 7.5 and 8.5. Without wishing to be bound by theory it is believed that optimized performance will be achieved at these pHs while minimizing the risk of damaging sensitive fabric surfaces.

Use

A further aspect of the present invention is the use of a process according to the present invention to treat garments, preferably wherein the garments comprise cotton, silk, wool, cashmere, viscose, polyamides, polyester, polyacrylics, polyurethanes or a mixture thereof, in order to minimise premature aging of the garments.

Method of Making

Those skilled in the art will be aware of known techniques to make the laundry treatment composition and dispensing means.

Combinations

Combination 1;

A. A process of treating at least one garment comprising the steps of;
   a. Spraying the at least one garment with a laundry treatment composition;
   b. Adding the at least one garment from step a to the drum of an automatic washing machine;
   c. Washing the at least one garment in the automatic washing machine wherein the drum comprises a wash liquor, wherein the wash liquor comprises water and the one or more garments and wherein the wash liquor has a temperature of 40° C. or less, and wherein the wash process takes between 1 minute and 90 minutes, and wherein the only laundry treatment composition added to the drum of the automatic washing machine is that used in step a.

B. The process according to A wherein the at least one garment is made from natural fabrics, synthetic fabrics, or a mixture thereof, preferably made from natural fabrics.

C. The process according to B wherein the at least one garment comprises cotton, silk, wool, cashmere, viscose, polyamides, polyester, polyacrylics, polyurethanes or a mixture thereof, preferably selected from cotton, wool, silk, cashmere or a mixture thereof, even more preferably selected from wool, silk, cashmere or a mixture thereof.

D. The process according to A-C wherein in step c, wherein the wash liquor has a temperature between 5° C. and 40° C., preferably between 6° C. and 35° C., more preferably between 7° C. and 30° C.

E. The process according to A-D wherein step c takes between 5 minutes and 60 minutes, preferably between 5 minutes and 40 minutes, more preferably between 5 minutes and 30 minutes, most preferably between 6 minutes and 20 minutes to complete.

F. The process according to A-E wherein between 7 L and 70 L, preferably between 7 L and 50 L, more preferably between 7 L and 30 L, most preferably between 7 L and 20 L of water are added to the drum to create the wash liquor.

G. The process according to A-F wherein the drum of the automatic washing machine rotates at a speed of between 0 rpm and 1700 rpm, preferably between 100 rpm and 1500 rpm, more preferably 100 rpm and 1300 rpm, most preferably between 100 rpm and 1000 rpm during the wash process.

H. The process according to A-G wherein sufficient laundry treatment composition is sprayed onto the at least one garment such that in step c, the wash liquor comprises between 50 ppm and 3000 ppm, preferably between 75 ppm and 2500 ppm, more preferably between 100 ppm and 2000 ppm, even more preferably between 125 ppm and 1750 ppm, yet more preferably between 150 ppm and 1500 ppm, most preferably between 175 ppm and 1250 ppm of the laundry treatment composition.

I. The process according to A-H wherein each garment is sprayed between 1 and 20 times, preferably between 1 and 10 times, more preferably between 1 and 4 times.

J. The process according to A-I wherein after step a no further laundry treatment composition is added to the at least one garment prior to it being added to the drum of the automatic washing machine.

K. The process according to A-J wherein the laundry treatment composition is a laundry detergent composition, a laundry softening composition, a laundry care composition, a laundry scent refresher composition or a mixture thereof.

L. The process according to A-K wherein the laundry treatment composition comprises surfactant, preferably wherein the surfactant is selected from anionic surfactant, non-ionic surfactant or a mixture thereof, preferably wherein the laundry treatment composition comprises between 1% and 15%, preferably between 4% and 12%, more preferably between 5% and 10% by weight of the laundry treatment composition of a surfactant.

M. The process according to A-L wherein the laundry treatment composition comprises a perfume, a chelant, a zwitterionic polyamine, a cationic polymer or a mixture thereof, preferably wherein the cationic polymer is a polysaccharide-based cationic polymer, more preferably a modified polysaccharide, wherein preferably the polysaccharide is a cellulose, more preferably a hydroxyethylcellulose.

N. The process according to any A-M wherein the at least one garment to be treated had previously been treated at least once, preferably at least twice, even more preferably at least three times in a fabric treatment process, preferably a fabric treatment process according to any preceding claims.

O. The process according to A-N wherein at most 10 garments, preferably at most 8 garments, more preferably at most 5 garments, most preferably at most 3 garments or even only one garment are added to the drum of the automatic washing machine.

Combination 2;

P. A process of treating a single garment comprising the steps of;

a. Spraying a single garment with a laundry treatment composition;

b. Adding the single garment from step a to the drum of an automatic washing machine wherein the drum comprises no further garments;

c. Washing the single garment in the drum of the automatic washing machine wherein water is added to the drum to create a wash liquor and wherein the garment is present within the wash liquor, and wherein the only laundry treatment composition added to the drum of the automatic washing machine is that used in step a.

wherein the single garment is made from natural fabrics, synthetic fabrics, or a mixture thereof, preferably made from natural fabrics.

Q. The process according to P wherein the single garment comprises cotton, silk, wool, cashmere, viscose, polyamides, polyester, polyacrylics, polyurethanes or a mixture thereof, preferably selected from cotton, wool, silk, cashmere or a mixture thereof, even more preferably selected from wool, silk, cashmere or a mixture thereof.

R. The process according to P or Q wherein in step c, wherein the wash liquor has a temperature between 5° C. and 40° C., preferably between 6° C. and 35° C., more preferably between 7° C. and 30° C.

S. The process according to P-R wherein between 7 L and 70 L, preferably between 7 L and 50 L, more preferably between 7 L and 30 L, most preferably between 7 L and 20 L of water are added to the drum to create the wash liquor.

T. The process according to P-S wherein step c takes between 1 minute and 90 minutes, preferably between 5 minutes and 60 minutes, more preferably between 5 minutes and 40 minutes, even more preferably between 5 minutes and 30 minutes, most preferably between 6 minutes and 20 minutes to complete.

U. The process according to P-T wherein the drum of the automatic washing machine rotates at a speed of between 0 rpm and 1700 rpm, preferably between 100 rpm and 1500 rpm, more preferably 100 rpm and 1300 rpm, most preferably between 100 rpm and 1000 rpm during the wash process.

V. The process according to P-U wherein sufficient laundry treatment composition is sprayed onto the garment such that in step c, the wash liquor comprises between 50 ppm and 2000 ppm, preferably between 75 ppm and 1750 ppm, more preferably between 100 ppm and 1500 ppm, even more preferably between 125 ppm and 1250 ppm of the laundry treatment composition.

W. The process according to P-V wherein the garment is sprayed between 1 and 20 times, preferably between 1 and 10 times, more preferably between 1 and 4 times.

X. The process according to P-W wherein after step a no further laundry treatment composition is added to the garment prior to it being added to the drum of the automatic washing machine.

Y. The process according to P-X wherein the laundry treatment composition is a laundry detergent composition, a laundry softening composition, a laundry care composition, a laundry scent refresher composition or a mixture thereof.

Z. The process according to P-Y wherein the laundry treatment composition comprises surfactant, preferably wherein the surfactant is selected from anionic surfactant, non-ionic surfactant or a mixture thereof, preferably wherein the laundry treatment composition comprises between 1% and 15%, preferably between 4% and 12%, more preferably between 5% and 10% by weight of the laundry treatment composition of a surfactant.

AA. The process according to P-Z wherein the laundry treatment composition comprises a perfume, a chelant, a zwitterionic polyamine, a cationic polymer or a mixture thereof, preferably wherein the cationic polymer is a polysaccharide-based cationic polymer, more preferably a modified polysaccharide, wherein preferably the polysaccharide is a cellulose, more preferably a hydroxyethylcellulose.

BB. The process according to P-AA wherein the single garment to be treated had previously been treated at least once, preferably at least twice, even more preferably at least three times in a fabric treatment process, preferably a fabric treatment process according to any preceding claims.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

EXAMPLES

A 100% viscose based black top item, commercially available from H&M Belgium (REF RN101255, size medium) has been divided in 2, resulting in 2 equal sized mirror shaped fabrics. One part has been washed using a traditional wash process as described below in more detail, while the second part has been washed according to the wash process of the invention, also described in more detail below. The wash process was repeated 10 times with in between line drying. The end fabrics have been shown to 16 consumers and requested to be graded according to the following scale:

1—I would definitely get rid of it
2—I would probably get rid of it
3—I may or may not get rid of it
4—I would probably not get rid of it
5—I would definitely not get rid of it Traditional Wash Process:

Wash load: test item+2.5 kg cotton and synthetic standard load

Wash cycle: 30° C. —1 h26 minutes wash cycle time

Wash product: Carrefour liquid detergent (Lavender), as commercially available in Belgium, 60 mL recommended dosage Wash Process According to the Invention:

Wash load: test item only, no further load added

Wash cycle: 20° C.—15 minutes rinse cycle

Wash product: 3 sprays spread on both front and back side of test item (8.7 ml product in total)—composition ex table 1

TABLE 1

Detergent composition for spraying fabrics according to process of the invention

| Wt % (100% active) | |
|---|---|
| Ethanol | 0.81 |
| 1,2 Propylene glycol | 0.37 |
| Citric Acid | 1.47 |
| HLAS | 1.09 |
| C24 EO7 nonionic surfactant | 0.40 |
| C45 EO7 nonionic surfactant | 0.39 |
| Na-salt of Diethylene triamine pentamethylphosphonic acid (DTPMP) - chelant | 0.11 |
| Palm Kernel Fatty Acid | 1.88 |
| zwitterionic polyamine (Lutensit Z96 ex BASF) | 0.14 |
| C24 AE3S anionic surfactant | 4.31 |
| CatHEC (Polymer PK ex Dow Company) | 0.5% |
| FWA36 | 0.001 |
| Perfume | 0.500 |
| Water and minors (silicone suds suppressor - preservative - NaOH for pH-trimming) | Balance |
| pH | 8.1 |

Test Results:

Consumers were clearly noticing a lower degree of ageing of the fabric washed according to the process of the invention, compared to the fabric washed with a traditional wash process:

87.5% of the consumers would probably or definitely get rid of the garment washed with reference product and process.

100% of the consumers would probably or definitely not get rid of the garment washed with the wash process according to the invention.

What is claimed is:

1. A process of treating at least one garment consisting of the steps of;

a. spraying the at least one garment with a laundry treatment composition;

b. adding the at least one garment from step a to the drum of an automatic washing machine;

c. washing the at least one garment from step a in the automatic washing machine wherein the drum comprises a wash liquor, wherein the wash liquor consists of water and between about 50 ppm and about 3000 ppm of the laundry treatment composition and wherein the only laundry treatment composition added to the drum of the automatic washing machine is that used in step a.

2. The process according to claim 1 wherein the at least one garment is made from natural fabrics, synthetic fabrics, or a mixture thereof.

3. The process according to claim 2 wherein the at least one garment comprises cotton, silk, wool, cashmere, viscose, polyamides, polyester, polyacrylics, polyurethanes or a mixture thereof.

4. The process according to claim 1 wherein sufficient laundry treatment composition is sprayed onto the at least one garment such that in step c, the wash liquor comprises between about 75 ppm and about 2500 ppm of the laundry treatment composition.

5. The process according to claim 4 wherein sufficient laundry treatment composition is sprayed onto the at least one garment such that in step c, the wash liquor comprises between about 125 ppm and about 1750 ppm of the laundry treatment composition.

6. The process according to claim 1 wherein in step c, the wash liquor has a temperature of about 40° C. or less.

7. The process according to claim 6, wherein in step c, the wash liquor has a temperature of between about 5° C. and about 40° C.

8. The process according to claim 1 wherein step c takes between about 1 minute and about 90 minutes to complete.

9. The process according to claim 8 wherein step c takes between about 5 minutes and about 60 minutes to complete.

10. The process according to claim 1 wherein between about 7 L and about 70 L of water are added to the drum to create the wash liquor.

11. The process according to claim 10, wherein between about 7 L and about 30 L of water are added to the drum to create the wash liquor.

12. The process according to claim 1 wherein the drum of the automatic washing machine rotates at a speed of between about 0 rpm and about 1700 rpm during the wash process.

13. The process according to claim 12 wherein the drum of the automatic washing machine rotates at a speed of between about 100 rpm and about 1500 rpm during the wash process.

14. The process according to claim 1 wherein each garment is sprayed between about 1 and about 20 times.

15. The process according to claim 1 wherein the laundry treatment composition is a laundry detergent composition, a laundry softening composition, a laundry care composition, a laundry scent refresher composition or a mixture thereof.

16. The process according to claim 1 wherein the laundry treatment composition comprises surfactant.

17. The process according to claim 1 wherein the laundry treatment composition comprises a perfume, a chelant, a zwitterionic polyamine, a cationic polymer or a mixture thereof.

18. The process according to claim 1 wherein the at least one garment to be treated had previously been treated at least once in a fabric treatment process according to claim 1.

19. The process according to claim 1 wherein at most about 10 garments are added to the drum of the automatic washing machine.

20. The process according to claim 1, wherein said process of treating at least one garment is a process for washing said at least one garment.

21. The process according to claim 20, wherein said laundry treatment composition comprises a cationic polysaccharide polymer.

* * * * *